US005296444A

United States Patent [19]

Saiki et al.

[11] Patent Number: 5,296,444

[45] Date of Patent: Mar. 22, 1994

[54] SUBLIMATION TRANSFER METHOD AND HEAT-MELT TRANSFER MEDIUM USED IN THE METHOD

[75] Inventors: Atsuo Saiki, Tokyo; Hideki Suematsu, Osaka; Manabu Ikemoto, Osaka; Hitomi Kawabata, Osaka, all of Japan

[73] Assignee: Fujicopian Co., Ltd., Osaka, Japan

[21] Appl. No.: 871,325

[22] Filed: Apr. 21, 1992

[30] Foreign Application Priority Data

Apr. 26, 1991 [JP] Japan ..... 3-96887

[51] Int. Cl.[5] ..... B41M 5/035; B41M 5/38

[52] U.S. Cl. ..... 503/227; 156/235; 428/195; 428/484; 428/488.1; 428/488.4; 428/913; 428/914

[58] Field of Search ..... 8/471; 428/195, 484, 428/488.1, 488.4, 913, 914; 503/227; 156/235

[56] References Cited

U.S. PATENT DOCUMENTS

| | | | |
|---|---|---|---|
| 4,021,591 | 5/1977 | DeVries et al. | 428/200 |
| 4,399,541 | 8/1983 | Kovats et al. | 372/36 |
| 4,803,361 | 2/1989 | Aiki et al. | 250/227 |

FOREIGN PATENT DOCUMENTS

| | | | |
|---|---|---|---|
| 57-102390 | 6/1982 | Japan | 503/227 |
| 2000730A | 1/1979 | United Kingdom | 503/227 |
| 2143180A | 2/1985 | United Kingdom | 503/227 |

OTHER PUBLICATIONS

Patent Abstracts of Japan, vol. 7, No. 170 (E-189), Jul. 27, 1983.

Patent Abstracts of Japan, vol. 9, No. 181 (E-331), Jul. 26, 1985.

patent Abstracts of Japan, vol. 11, No. 81 (E-488), Mar. 12, 1987.

Patent Abstracts of Japan, vol. 12, No. 30 (E-578), Jan. 28, 1988.

Applied Optics, vol. 27, No. 13, Jul. 1, 1988, New York, U.S., p. 2632.

The Fifth International Congress on Advances in Non-Impact Printing Technologies, K. Kuroda: 'New Color Thermal Transfer Printing Media', Nov. 12, 1989, San Diego, U.S.A., pp. 524-531.

Patent Abstracts of Japan, vol. 6, No. 56 (M-121) (934), Apr. 1992, for JP-A-56-167490.

*Primary Examiner*—B. Hamilton Hess

*Attorney, Agent, or Firm*—Armstrong, Westerman, Hattori, McLeland & Naughton

[57] ABSTRACT

In a sublimation transfer method wherein a heat-meltable ink layer containing a sublimation dye is melt-transferred to give a master having an image of the ink, and the sublimation dye in the ink image is heat-transferred to form a dyed image on a substrate, there is used a heat-melt transfer medium wherein a release layer comprising a wax-like substance as a major component is provided between a foundation and the ink layer, or an adhesive layer comprising a wax-like substance as a major component is provided on the ink layer, or both the release layer and the adhesive layer are provided. The releasability of the ink layer from the foundation and the adhesiveness of the ink layers with each other are good. The method is especially useful to form a full-color dyed image.

14 Claims, 6 Drawing Sheets

SUBLIMATION TRANSFER METHOD AND HEAT-MELT TRANSFER MEDIUM USED IN THE METHOD

BACKGROUND OF THE INVENTION

The present invention relates to a sublimation transfer method for producing dyed images, such as letters, symbols and patterns, on cloth goods such as shirts, and a heat-melt transfer medium used in the method.

Heretofore there is known a sublimation transfer method which comprises using a heat-melt transfer medium having on a foundation a heat-meltable ink layer containing a sublimation dye as a coloring agent, selectively melt-transferring the heat-meltable ink layer onto a sheet having a good absorptive property by heating with a heating head to prepare a master having an image of the ink, superimposing the master onto a substrate so that the image faces the substrate and heating the resultant master/substrate at a temperature not less than the heat-transfer temperature of the sublimation dye to transfer the dye to the substrate, thereby yielding a monochromatic dye image, and a heat-melt transfer medium used in the method (Japanese Examined Patent Publication No. 58080/1989). According to the sublimation transfer method, the master is prepared by using a thermal transfer printer. Therefore, the sublimation transfer method has the advantage that dye images of arbitrary letters, symbols or patterns (hereinafter those are generically represented by "patterns") can be readily formed on the substrate, as compared with a conventional sublimation printing method.

However, the above-mentioned sublimation transfer method and the transfer medium used therein have the following drawbacks.

When the content of sublimation dye in the heat-meltable ink layer is increased in order to increase the density of the dye image in the above method, the ink layer has a poor adhesiveness to a sheet for a master, which results in failure to form a master with a clear image. Further, the portion of the heat-meltable ink layer that is heated with a heating head does not necessarily have a sufficient releasability from the foundation, which also results in failure to form a master with a clear image.

In particular, when the sublimation transfer method and the transfer medium are applied to the formation of polychromatic or full-color dye images, the poor releasability and adhesiveness of the heat-meltable ink layer cause serious problems.

In the formation of full-color dye images, two or more kinds of ink dots selected from a heat-meltable ink layer containing a yellow sublimation dye, a heat-meltable ink layer containing a magenta sublimation dye and a heat-meltable ink layer containing a cyan sublimation dye must be superimposed one on another on the sheet for a master. When the conventional method is applied, the superimposition of such ink dots is not favorably effected because of the poor releasability of the ink dots from the foundation and the poor adhesiveness of ink dots one on another, which results in failure to form a desired full-color dye image.

In the case of forming a full-color dye image, plural gradations are required for each color. However, if the release of ink dots and the superimposition of ink dots one on another are not favorably effected, a desired gradation cannot be obtained.

In the case of producing a plurality of gradations by an area-modulation method with respect to a color, for example, a picture element is composed of 2×2 dot matrix and the number of dots included in the dot matrix is varied within the range of 1 to 4, thereby giving four gradations for the color. In this case, if ink dots are favorably released from the transfer medium or an ink dot is not favorably adhered to the master sheet or another ink dot which has been transferred to the master sheet, a predetermined number of ink dots cannot be deposited to the predetermined positions within the matrix, which results in failure to obtain a desired gradation.

It is an object of the present invention to provide a sublimation transfer method wherein ink dots are readily released from the transfer medium and the ink dots are well adhered to a sheet for a master to give a master with a clear image, which results in the formation of a clear dye image on a substrate; and a heat-melt transfer medium used in the method.

Another object of the present invention is to provide a sublimation transfer method which gives a master having an excellent full-color ink image, resulting in the formation of an excellent full-color dye image on a substrate.

These and other objects of the invention will become apparent from the description hereinafter.

SUMMARY OF THE INVENTION

The present invention provides a sublimation transfer method comprising the steps of:

using a heat-melt transfer medium comprising a foundation, a release layer provided on the foundation and comprising a wax-like substrate as a major component, and a heat-meltable ink layer provided on the release layer and containing a sublimation dye as a coloring agent, selectively melt-transferring the heat-meltable ink layer of said transfer medium onto a sheet for a master to form an image of the ink on the sheet, giving a master, superimposing the master onto a substrate so that the image faces the substrate and heating the resultant master/substrate at a temperature not less than the heat-transfer temperature of the sublimation dye to transfer the dye to the substrate; and a heat-melt transfer medium used in the method (hereinafter referred to as "first embodiment").

The present invention further provides a sublimation transfer method wherein a transfer medium which further has an adhesive layer comprising a wax-like substance as a major component on the above-mentioned heat-meltable ink layer is used in the above-mentioned sublimation transfer method; and a heat-melt transfer medium used in the method (hereinafter referred to as "third embodiment").

The present invention further provides a sublimation transfer method comprising the steps of:

using a heat-melt transfer medium comprising a foundation, a heat-meltable ink layer provided on the foundation and containing a sublimation dye as a coloring agent, and an adhesive layer provided on the ink layer and comprising a wax-like substance as a major component, selectively melt-transferring the heat-meltable ink layer of said transfer medium onto a sheet for a master to form an image of the ink on the sheet, giving a master, superimposing the master onto a substrate so that the image faces the substrate and heating the resultant master/substrate at a temperature not less than the heat-transfer temperature of the sublimation dye to transfer the dye to the substrate; and a heat-melt transfer medium used in the method (hereinafter referred to as "second embodiment).

According to the sublimation transfer method of the present invention, the heat-meltable ink layer containing a sublimation dye has a good releasability from the foundation and a good adhesiveness to a sheet for a master, thereby giving a master with a clear image, which results in the formation of a clear dye image. Further, since the adhesiveness of the ink layers with each other is good, there can be obtained a master with a good full-color ink image, which gives a good full-color dye image.

DETAILED DESCRIPTION

Figure 1:
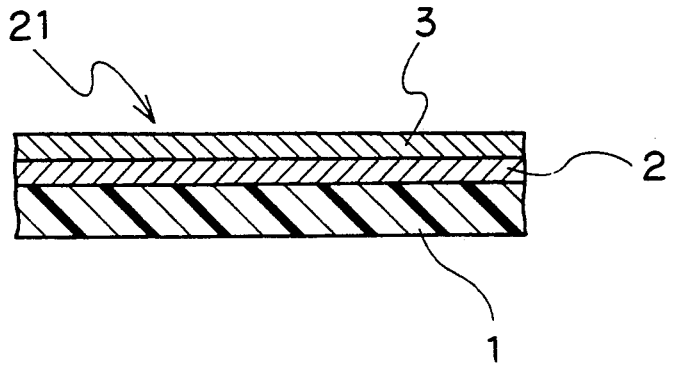
FIG. 1 is a schematic section showing a heat-melt transfer medium according to the first embodiment of the present invention.

The first embodiment of the present invention uses a heat-melt transfer medium comprising a foundation, a release layer provided on the foundation and comprising a wax-like substance as a major component, and a heat-meltable ink layer provided on the release layer and containing a sublimation dye as a coloring agent.

In the first embodiment, the release layer composed of a wax-like substance as a major component is interposed between the foundation and the heat-meltable ink layer. Upon heat-transferring, the release layer in a heated portion is sharply melted to become a melt having a low viscosity, thereby facilitating the heat transfer of the ink layer. As a result, there can be obtained a master with a clear ink image, which gives a clear dye image on a substrate.

In particular, the ink dots corresponding to the activated heating elements of the heating head are surely transferred to the sheet for a master without causing dropout of any dot, thereby enabling the representation of a desired gradation. Consequently, a good full-color dye image can be obtained.

Further, some portion of the wax-like substance of the release layer remains on the ink dot transferred on the sheet for a master, so that when another ink dot with different color is transferred on the ink dot, the former is favorably adhered to the latter. This is also an advantage in forming a full-color dye image.

The second embodiment of the present invention uses a heat-melt transfer medium comprising a foundation, a heat-meltable ink layer provided on the foundation and containing a sublimation dye as a coloring agent, and an adhesive layer provided on the ink layer and comprising a wax-like substance as a major component.

In the second embodiment, the adhesive layer composed of a wax-like substance as a major component exists on the ink layer. Since the adhesive layer shows a good adhesiveness to the sheet for a master and another ink layer in a molten state, an ink dot is surely fixed to the sheet for a master or another ink dot with different color which has been transferred to the sheet for a master, thereby giving a master with a clear ink image. As a result, a clear dye image is obtained on a substrate.

In particular, the ink dots corresponding to the activated heating elements of the heating head are surely fixed to the sheet for a master or another ink dot previously transferred to the sheet without causing dropout of any ink dot, thereby enabling the representation of a desired gradation. Consequently, a good full-color dye image can be obtained.

In the prior art described in Japanese Examined Patent Publication No. 58080/1989 mentioned above, a sheet which well absorbs the vehicle of the heat-meltable ink is used as a sheet for a master and the vehicle of the ink image transferred to the sheet is caused to be absorbed into the sheet, thereby preventing the blur of dye image which is caused by the transfer of the vehicle of the ink image to a substate in the sublimation transfer step. In that case, there is the problem that the sublimation dye is also absorbed into the tissue of the sheet, so that a long time is required for the transfer of the dye.

According to the second embodiment, however, the sublimation dye is not permeated into the tissue of a plain paper to an extra extent in the case that the plain paper is used as a sheet for a master because the wax-like substance of the adhesive layer is permeated into the tissue of the paper. As a result, there is the advantage that the transfer of the dye is effected in a short time. In particular, when the dyes in the ink dots superimposed one on another are simultaneously transferred to a substrate in order to form a full-color dye image, the dye in the ink dot directly transferred to the sheet for master is also favorably transferred.

The third embodiment of the present invention has the above-mentioned advantages of both the first embodiment and the second embodiment and is especially useful for forming a full-color dye image. That is, with respect to the ink dot previously transferred to the sheet for a master, a part of the release layer exists on the ink dot. When another ink dot with different color is transferred to the ink dot on the master sheet, both the ink dots with different colors are much favorably adhered to each other because the adhesive layer exists on the surface of the former ink dot that faces the latter ink dot. When the release layer and the adhesive layer have the same formula, this effect is outstanding.

The present invention will be more specifically explained by referring to the accompanying drawings.

FIG. 1 is a schematic section showing an example of the heat-melt transfer medium used in the first embodiment of the present invention. In FIG. 1, reference numeral 21 indicates a transfer medium wherein a release layer 2 composed of a wax-like substance as a major component is provided on a foundation 1 and a heat-meltable ink layer 3 containing a sublimation dye as a coloring agent is provided on the release layer 2.

Figure 2:
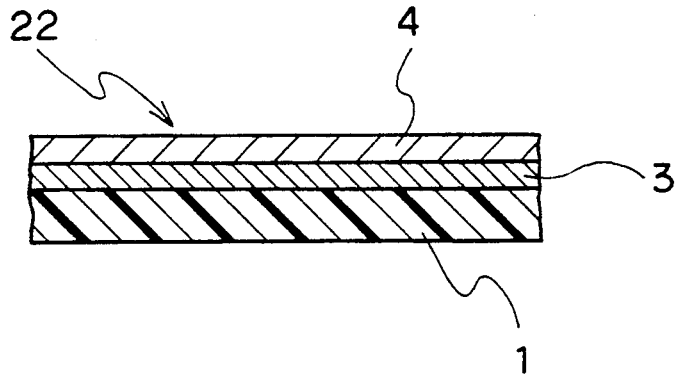
FIG. 2 is a schematic section showing a heat-melt transfer medium according to the second embodiment of the present invention.

FIG. 2 is a schematic section showing an example of the heat-melt transfer medium used in the second embodiment of the present invention. In FIG. 2, reference numeral 22 indicates a transfer medium wherein a heat-meltable ink layer 3 is provided on the foundation 1, and an adhesive layer 4 composed of a wax-like substance as a major component is provided on the ink layer 3.

Figure 3:
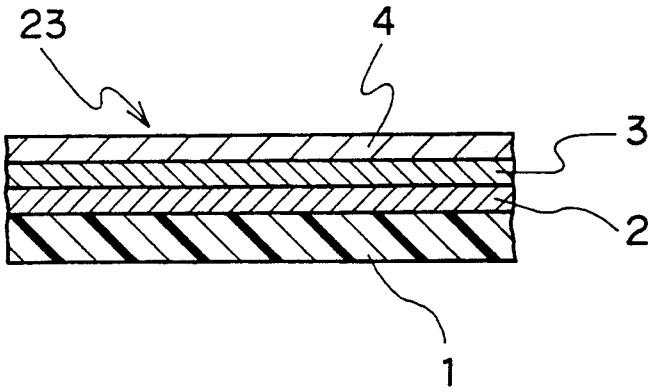
FIG. 3 is a schematic section showing a heat-melt transfer medium according to the third embodiment of the present invention.

FIG. 3 is a schematic section showing an example of the heat-melt transfer medium used in the third embodiment of the present invention. In FIG. 3, reference numeral 23 indicates a transfer medium wherein the release layer 2 is provided on the foundation 1, the heat-meltable ink layer 3 is provided on the release layer 2, and the adhesive layer 4 is provided on the ink layer 3.

Figure 4:
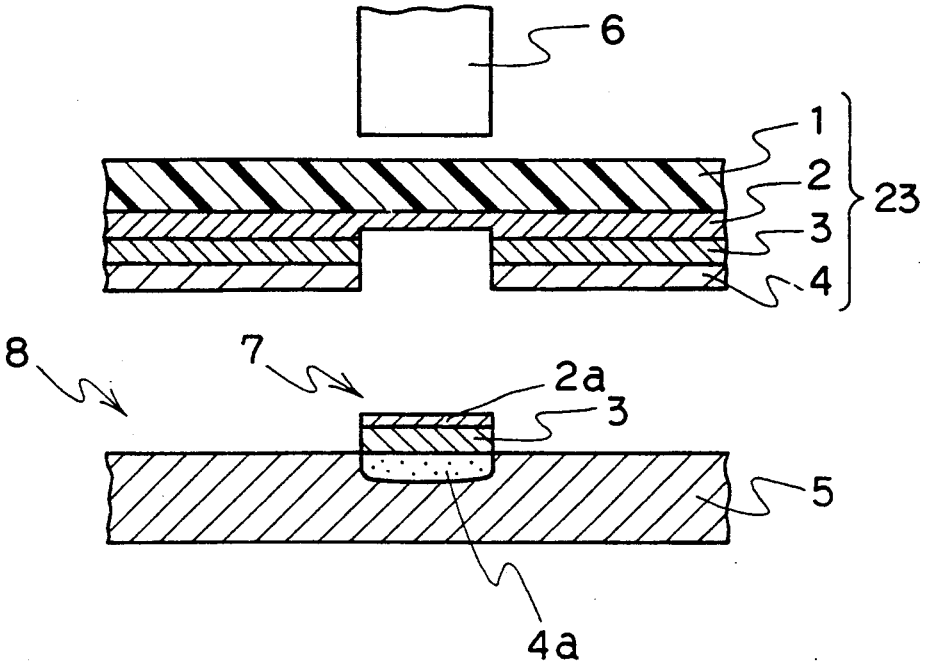
FIG. 4 is an explanatory view showing the step of preparing a master in the third embodiment of the present invention.
Figure 5:
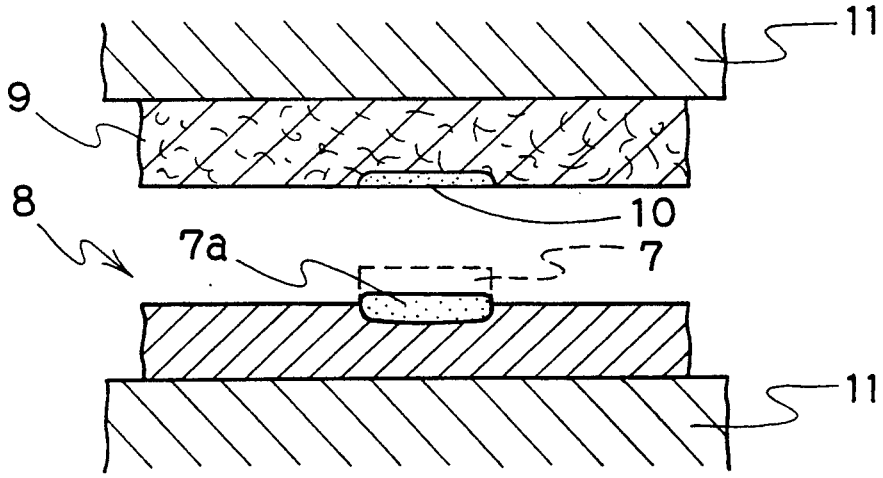
FIG. 5 is an explanatory view showing the sublimation transfer step in the third embodiment of the present invention.

FIGS. 4 and 5 are explanatory views showing the successive steps of the sublimation transfer method in accordance with the third embodiment of the present invention.

As shown in FIG. 4, the heat-melt transfer medium 23 is laid upon a sheet 5 for a master. When the assembly is heated from the side of the foundation 1 of the transfer medium 23 by means of a heating head 6 of a thermal printer, the heated portion of the transfer layer is selectively melt-transferred to the sheet 5 for a master to give a master 8 with an ink image 7. The ink image 7, for example, has such a state wherein the melted adhesive layer 4 is absorbed into the master sheet (reference numeral 4*a* indicates the portion where the adhesive layer is absorbed), the ink layer 3 is substantially put on the surface of the master sheet, and a transferred portion 2*a* of the release layer 2 is put on the ink layer.

As shown in FIG. 5, the thus obtained master 8 is laid upon a substrate 9 such as a fabric so that the ink image 7 faces the substrate 9. When the assembly is heated by means of a heating means such as heating plates 11 at a temperature not less than the heat-transfer temperature of the sublimation dye, the sublimation dye contained in the ink image 7 is heat-transferred to the substrate 9 and the tissue thereof is dyed with the sublimation dye to give a dye image 10. Reference numeral 7*a* indicates the residue of the ink image 7 after the sublimation dye is transferred.

The sublimation transfer method according to the first embodiment and the second embodiment can also be conducted in the same manner as mentioned above.

The release layer in the present invention is a heat-meltable layer composed of a wax-like substance as a major component.

Examples of the wax-like substance include natural waxes such as whale wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene and Fischer-Tropsch wax; higher fatty acids such as lauric acid, myristic acid, palmitic acid, stearic acid and behenic acid; higher aliphatic alcohols such as stearyl alcohol and behenyl alcohol; esters such as higher fatty acid monoglycerides, sucrose fatty acid esters and sorbitan fatty acid esters; and amides such as oleic amide. These wax-like substances may be used singly or in admixture. Preferred wax-like substances have a melting point of 50° to 100° C.

The release layer preferably has a melting point of 50° to 100° C. When the melting point of the release layer is lower than the above range, the storage stability of the transfer medium is poor. When the melting point of the release layer is higher than the above range, the releasability of the ink layer is poor.

The release layer preferably has a thickness of 0.2 to 3 μm. When the thickness of the release layer is less than the above range, the releasability of the ink layer is poor. Further, the amount of the release layer 2*a* which exists on the ink image 7 on the master becomes small, which results in a poor adhesiveness between ink dots with different colors which are superimposed one on another. When the thickness of the release layer is more than the above range, the transfer sensitivity is poor, the abrasion resistance of the ink image on the master is poor or there occurs the phenomenon that the ink layer falls off in the form of flakes.

The heat-meltable ink in the present invention is composed of a heat-meltable vehicle and a sublimation dye as a coloring agent.

The sublimation dye used in the present invention is that which is heat-transferable upon heating. Conventional sublimation dyes used in sublimation thermal transfer method, sublimation transfer printing method, and the like can be used without any particular limitation. Examples thereof are as follows:

Yellow Sublimation Dye

C.I. Disperse Yellow 3 (azobenzene dye), 23 (disazo dye), 7,60 (pyrazoloneazo dye), 13 (benzanthrone dye), 54 (quinophthalone dye), 61 (methine dye), 82 (coumarin dye), 1, 5, 42, 141, 201, E, E-GRL Magenta Sublimation Dye C.I. Disperse Red B, 1 (aminoazobenzene dye), 17, 4 (1-amino-4-hydroxyanthraquinone dye), 60, 135, 167, 210

C.I. Disperse Violet 26

C.I. Solvent Red 19

Cyan Sublimation Dye

C.I. Disperse Blue 14, 26 (4,8-diaminoanthraquinome dye), 3, 24, 56, 20 (naphthoquinone dye), 106

C.I. Solvent Blue 36, 63, 105, 112

C.I. Disperse Violet 28 (1,4-diaminoanthraquinome dye)

These sublimation dyes for each color may be used singly or in admixture. Black color is obtained by mixing the above-mentioned yellow, magenta and cyan sublimation dyes in an appropriate ratio. Of course, sublimation dyes other than the above-mentioned yellow, magenta and cyan sublimation dyes can be used. Sublimation dyes having a heat-transfer temperature of not less than 60° C. are suitably used.

The vehicle of the heat-meltable ink is composed of a wax-like substance or a mixture of a wax-like substance and a heat-meltable resin, and optionally an oily substance.

As the wax-like substance, there can be used those for the above-mentioned release layer. Heat-meltable resins which are compatiable or miscible with the wax-like substance are suitably used. Examples of the heat-meltable resin are xylene resin, coumarone-indene resin, styrene resin, ethylene-vinyl acetate copolymer resin, ethylene-butadiene copolymer resin, acrylic acid ester resin, polyamide resin, polyester resin and polyurethane resin. These resins may be used singly or in admixture. Heat-meltable resins having a melting or softening temperature of 40° to 160° C. are suitably used. Examples of the oily substance are vegetable oils such as rapeseed oil and castor oil, mineral oils such as motor oil and spindle oil, and plasticizer such as dioctyl phthalate, dibutyl phthalate and tricresyl phosphate. A surface active agent may be added to the heat-meltable ink to improve the dispersibility of the sublimation dye. Examples of the surface active agent are sorbitan fatty acid ester, polyoxyethylene alkylphenyl ether and phosphoric acid alkyl ester.

The content of the sublimation dye in the heat-meltable ink layer is preferably from 5 to 70% (% by weight, hereinafter the same), especially from 20 to 45%. Since the release layer and/or the adhesive layer are provided in the present invention, the melt-transfer of the ink layer is favorably effected even in the case that the content of the sublimation dye in the ink layer is in a high range of 30 to 70%, especially 35 to 70%, thereby giving a dye image with a high density. The vehicle may be composed of a wax-like substance alone. However, from the viewpoint of improving the application property, etc., it is preferable to use a heat-meltable resin in combination. When the heat-meltable resin is used in combination, the amount of the heat-meltable resin is preferably from 20 to 100 parts (parts by weight, hereinafter the same), especially from 40 to 80 parts, per 100 parts of the wax-like substance. When the amount of the resin is less than the above range, the effect of improving the application property is not exhibited, and in the case that the sheet for a master is porous, the heating time in the sublimation transfer step tends to become longer because the ink permeates into the sheet. When the amount of the resin is more than the above range, an unwanted transfer of the ink layer which means the phenomenon that the ink is peeled off in an larger area including not only the heated portion but also the circumference thereof, occurs and the reproducibility of ink dot becomes poor, which results in failure to obtain a desired gradation.

The heat-meltable ink layer preferably has a melting point of 50° to 100° C. and a viscosity of 300 to $5\times10^5$ cP at 90° C. (value measured by means of a rheometer made by Rheology Co., Ltd., hereinafter the same). When the melting point of the ink layer is less than the above range, the storage stability of the transfer medium is poor. When the melting point is more than the above range, the melt-transferability is poor. When the viscosity at 90° C. is less than the above range, the strength of the ink layer is decreased so that the ink image on the master tends to be smeared. When the viscosity is more than the above range, the heat-transferability is poor.

The thickness of the heat-meltable ink layer is preferably from 0.5 to 5 μm. When the thickness is less than the above range, the density of the obtained dye image is too low. When the thickness is more than the above range, the transfer sensitivity is poor, the abrasion resistance of the ink image on the master is poor or there occurs the phenomenon that the ink layer falls off in the form of flakes.

The adhesive layer in the present invention is a heat-meltable layer composed of a wax-like substance as a major component. As the wax-like substance, there can be used those for the above-mentioned release layer. The melting point of the adhesive layer is preferably from 50° to 100° C. When the melting point is less than the above range, the storage stability of the transfer medium is poor. When the melting point is more than the above range, the adhesiveness is poor. The thickness of the adhesive layer is preferably from 0.2 to 3 μm. When the thickness of the adhesive layer is less than the above range, the adhesiveness is poor. When the thickness is more than the above range, the abrasion resistance of the ink image on the master is poor, the registering between the ink dots with different colors when they are superimposed one on another tends to become inaccurate, and the ink image on the master tends to be blurred.

In the third embodiment, the release layer and the adhesive layer preferably have substantially the same composition (the kind of the materials, mixing ratio, etc.), and further substantially the same physical properties such as melting point and viscosity. When ink layers with different colors are superimposed one on another (refer to FIG. 7), the release layer and adhesive layer having the same composition, further the same physical properties are adhered to each other by the virtue of such a means so that the ink layers with different colors are favorably superimposed. Thus, there can be obtained a master having a full-color ink image with a better quality, which results in the formation of a full-color dye image with a better quality.

Each of the above-mentioned layers can be formed by applying the composition for each layer in a solvent solution or a dispersion, or by hot-melt coating of the composition as it is. The release layer or the adhesive layer can also be formed by applying an aqueous emulsion of a wax-like substance. The formation of the ink layer and the adhesive layer is preferably conducted at a temperature of lower than the transfer temperature of the sublimation dye.

Heat-resistant plastic films such as polyester film, nylon film, cellulose triacetate film, polycarbonate film and polyimide film, and high density papers such as glassine paper and condenser paper can be preferably used as the foundation. The thickness of the foundation is preferably from 2 to 10 μm.

Materials similar to those used as foundation can be used as the sheet for a master. Generally, however, plain papers are preferably used. Plain papers having a wide range of smoothness, including a good smoothness (e.g. Bekk smoothness: about 1,000 seconds) and a very poor smoothness (e.g., Bekk smoothness: about 50 seconds), can be used. Smooth papers are suitable in the case of using the transfer media of the first embodiment and the second embodiment.

Any material capable of being dyed with such sublimation dyes as mentioned above can be used as a substrate to be dyed without any particular limitation. Generally, however, woven or nonwoven fabrics of fibers can be preferably used. Examples of the fibers are polyester fibers, polyamide fibers, acrylic fibers and nylon fibers. Of course, plastic films or sheets can be used.

In the sublimation transfer method of the present invention, the preparation of the master can be conducted by using usual selective thermal transfer printers equipped with a heating head, a laser head, etc. A master with a full-color image can be readily prepared by reading an image with a full-color by means of an image scanner and inputting the color-separated output from the image scanner to the thermal transfer printer.

Iron (electric or steam iron), hot plate, etc, other than the above-mentioned heat press using the heating plates, can also be used as the heating means in the sublimation transfer step. The heating temperature and time varies depending upon the kind of sublimation dye and other conditions. Generally, however, the heating temperature is suitably selected from the range of not lower than the heat-transfer temperature of the sublimation dye used and less than the temperature at which the heat shrinking of the substrate and master sheet used takes place, and the heating time is suitably selected from the range of 5 seconds to 2 minutes. When the heating temperature is from about 180° to about 220° C., a clear dye image can be obtained in a short heating time of about 5 to about 30 seconds.

In the present invention, either a continuous monochromatic ink layer may be provided on a single foundation, or plural ink layers with different colors may be provided in an arbitrary color order in a side-by-side relationship on a single foundation.

Figure 6:
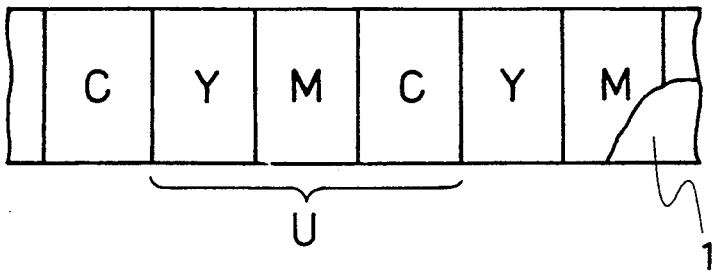
FIG. 6 is a plan view showing an example of the arrangement of ink layers with dyes of different colors in the heat-melt transfer medium of the present invention.

The formation of a full-color dye image is usually conducted by using three kinds of ink layers containing yellow, magenta and cyan sublimation dyes, respectively, and utilizing subtrative color mixture of three primary colors. An example of a transfer medium used for forming a full-color dye image is shown in FIG. 6. In FIG. 6, a yellow ink layer Y, a magenta ink layer M and a cyan ink layer C are disposed repeatedly on a continuous foundation 1 in a repeating unit U in the longitudinal direction thereof. Herein the term "yellow ink layer Y" is a concept including the heat-meltable ink layer 3, and the release layer 2 and/or the adhesive layer 4 as shown in FIGS. 1 to 3. This is held with respect to the magenta ink layer and the cyan ink layer. The order of arrangement of three different color ink layers is selected arbitrarily. The respective ink layers may be provided either in such a manner that the adjacent ink layers are in a close contact to each other, or in such a manner that there is a spacing between the adjacent ink layers. Further, the respective ink layers may be provided in such a manner that the adjacent ink layers overlap partially with each other unless there is any practical hindrance. Markers for controlling the feed of the transfer medium may be provided in the margin which is provided on one edge portion or both edge portions in the longitudinal direction of the foundation 1. Further, the repeating unit U may include a black ink layer.

Figure 7:
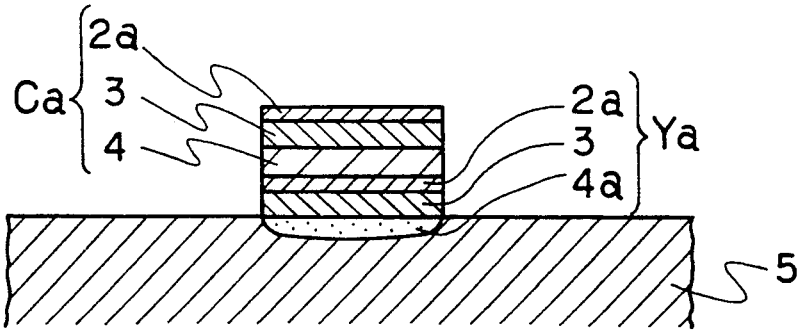
FIG. 7 is an explanatory view showing superimposition of ink dots one on another on the master prepared by the sublimation transfer method of the present invention.

In forming a full-color dye image, a yellow separated ink image and a magenta separated ink image and a cyan separated ink image are formed and superimposed on a sheet for master by means of a thermal printer using a transfer medium as shown in FIG. 6. FIG. 7 is a schematic section showing the superimposition of the ink dots with different colors on the thus obtained master (the master obtained by using the transfer medium of the third embodiment). In FIG. 7, reference numeral Ya indicates the ink dot transferred from the yellow ink layer Y and reference numeral Ca indicates the ink dot transferred from the cyan ink layer C. The order of formation of the respective color-separated ink images is arbitrary. The formation of a full-color master image can also be conducted by using three kinds of transfer media having the yellow ink layer Y, the magenta ink layer M and the cyan ink layer C on separate foundations, respectively, without using the transfer medium as shown in FIG. 6.

When the operation of the sublimation transfer step as shown in FIG. 5 is conducted using the full-color master as obtained above, a full-color dye image is obtained on a substrate. Incidentally a dot dyed in green is obtained from the ink dots superimposed as shown in FIG. 7. A full-color dye image can also be formed by preparing a master having a yellow separated ink image, a master having a magenta separated ink image and a master having a cyan separated ink image, respectively, and conducting three times the operation of the sublimation transfer step, as shown in FIG. 5, using these masters.

In the case of obtaining intermediate colors other than green, red and blue by using a full-color master, it is necessary to provide plural gradations for each of yellow, magenta and cyan. Such a color with gradations can be obtained by an area-modulation method wherein one picture element is composed of M×N dot matrix, wherein M and N are, usually, independently an integer of 2 to 8, and the number of dots included in the dot matrix is varied.

The present invention is more specifically described and explained by means of the following Examples. It is to be understood that the present invention is not limited to the Examples, and various changes and modifications may be made in the invention without departing from the spirit and scope thereof.

EXAMPLE 1

On a continuous polyester film having a thickness of 6 μm and a width of 297 mm was applied and dried a solution prepared by dissolving 7.2 parts of paraffin wax (m.p. 79° C.), 0.8 part of carnauba wax (m.p. 83° C.) and 2 parts of microcrystalline wax (m.p. 79° C.) into 90 parts of toluene, giving a release layer having a thickness of 1 μm and a melting point of 76° C.

The respective ink solutions for yellow, magenta and cyan each having the formula shown in Table 1 were applied onto the release layer and dried to give ink layers arranged as shown in FIG. 6. Each ink layer had a length of 210 mm in the longitudinal direction of the foundation film. The physical properties of each ink layer are shown in Table 1.

The same wax solution as used in forming the above-mentioned release layer was applied onto the ink layers and dried to give an adhesive layer having a thickness of 1 μm and a melting point of 76° C., yielding a heat-melt transfer medium in accordance with the third embodiment.

TABLE 1

| | Yellow | Magenta | Cyan |
|---|---|---|---|
| Formula of ink (part) | | | |
| Yellow-A-G*1 | 8.3 | — | — |
| Red-130*2 | — | 8.3 | — |
| Blue-F-R*3 | — | — | 9.8 |
| Carnauba wax | 5.0 | 5.0 | 4.3 |
| Paraffin wax | 4.7 | 4.7 | 3.6 |
| EVA*4 | 6.0 | 6.0 | 6.2 |
| Toluene | 76.0 | 76.0 | 76.1 |
| Physical properties of ink layer | | | |
| Thickness (μm) | 1 | 1 | 1 |
| Content of dye (%) | 35 | 35 | 41 |

TABLE 1-continued

| | Yellow | Magenta | Cyan |
|---|---|---|---|
| Melting point (°C.) | 73 | 73 | 73 |

*1: Disperse Yellow 54 made by Nippon Kayaku Co., Ltd.
*2: Disperse dye made by Nippon Kayaku Co., Ltd.
*3: Solvent Blue 105 made by Nippon Kayaku Co., Ltd.
*4: Ethylene-vinyl acetate copolymer (softening point: 135° C.)

EXAMPLE 2

The same procedures as in Example 1 except that no adhesive layer was provided were repeated to give a heat-melt transfer medium in accordance with the first embodiment.

EXAMPLE 3

The same procedures as in Example 1 except that no release layer was provided, i.e. each ink layer was provided directly on the foundation film, were repeated to give a heat-melt transfer medium in accordance with the second embodiment.

COMPARATIVE EXAMPLE

Onto a continuous polyester film having a thickness of 6 μm and a width of 297 mm were applied and dried the respective ink solutions for yellow, magenta and cyan each having the formula shown in Table 2 to give ink layers arranged as shown in FIG. 6, yielding a heat-melt transfer medium. Each ink layer had a length of 210 mm in the longitudinal direction of the foundation film. The physical properties of each ink layer are shown in Table 2.

TABLE 2

| | Yellow | Magenta | Cyan |
|---|---|---|---|
| Formula of ink (part) | | | |
| Yellow-A-G | 8.3 | — | — |
| Red-130 | — | 8.3 | — |
| Blue-F-R | — | — | 9.8 |
| Carnauba wax | 9.0 | 9.0 | 8.0 |
| Paraffin wax | 5.0 | 5.0 | 4.5 |
| EVA* | 2.0 | 2.0 | 1.8 |
| Toluene | 75.7 | 75.7 | 75.9 |
| Physical properties of ink layer | | | |
| Thickness (μm) | 1 | 1 | 1 |
| Content of dye (%) | 35 | 35 | 41 |
| Melting point (°C.) | 70 | 70 | 70 |

The following tests were conducted with respect to the heat-melt transfer media obtained in Examples 1 to 3 and Comparative Example.

(1) Test I

Letter images in yellow ink, letter images in magenta ink and letter images in cyan ink were formed on the sheets for a master mentioned below, respectively, by means of the below-mentioned thermal transfer printer using each transfer medium mentioned above to give respective masters. Each master was laid on the top of a polyester fabric and the assembly was sandwiched between 2 heating plates as shown in FIG. 5 and heat-pressed under the conditions mentioned below to form images dyed in yellow, images dyed in magenta or images dyed in cyan on the fabric.

Printer: Color Mate PS made by NEC Corporation

Sheet for master: plain paper having a thickness 70 μm (Bekk smoothness: 360 seconds, 127 seconds and 50 seconds)

Heat press:

Heating temperature: 200° C.

heating time: 15 seconds

Pressure: 6 kg/cm$^2$

The dyed images were observed with the naked eye and the clearness thereof was evaluated according to the following ranking. The results thereof are shown in Table 3.

A: The letter could be read very clearly.

B: The letter could be read clearly.

C: The letter could be read although it was unclear.

D: The letter could not be read.

TABLE 3

| | Ex. 1 | Ex. 2 | Ex. 3 | Com. Ex. |
|---|---|---|---|---|
| Smoothness of master sheet | | | | |
| 360 seconds | A | B | B | C |
| 127 seconds | A | C | B | C |
| 50 seconds | B | C | C | D |

As is clear from the results of Table 3, in the case of using the transfer medium having both the release layer and the adhesive layer (Example 1) in accordance with the third embodiment of the present invention, clear images could be obtained not only on the master sheet having a good smoothness but also on the master sheet having a poor smoothness, which resulted in obtaining clear dyed images. In the case of using the transfer medium having only the release layer (Example 2) in accordance with the first embodiment of the present invention and the transfer medium having only the adhesive layer (Example 3) in accordance with the second embodiment of the present invention, clear images could be obtained when the smoothness of the master sheet used was good, which resulted in obtaining clear dyed images.

In contrast thereto, in the case of Comparative Example having none of the release layer and the adhesive layer, clear images could not be obtained even though the smoothness of the master sheet is good, which resulted in failure to obtain clear dyed images.

(2) Test II

The same procedures as in Test I except that in forming a master, one picture element was composed of 4×4 matrix to give images with 16 gradations for each color were repeated to form images dyed on a polyester fabric for the purpose of investigating the representation of gradation.

Figure 8:
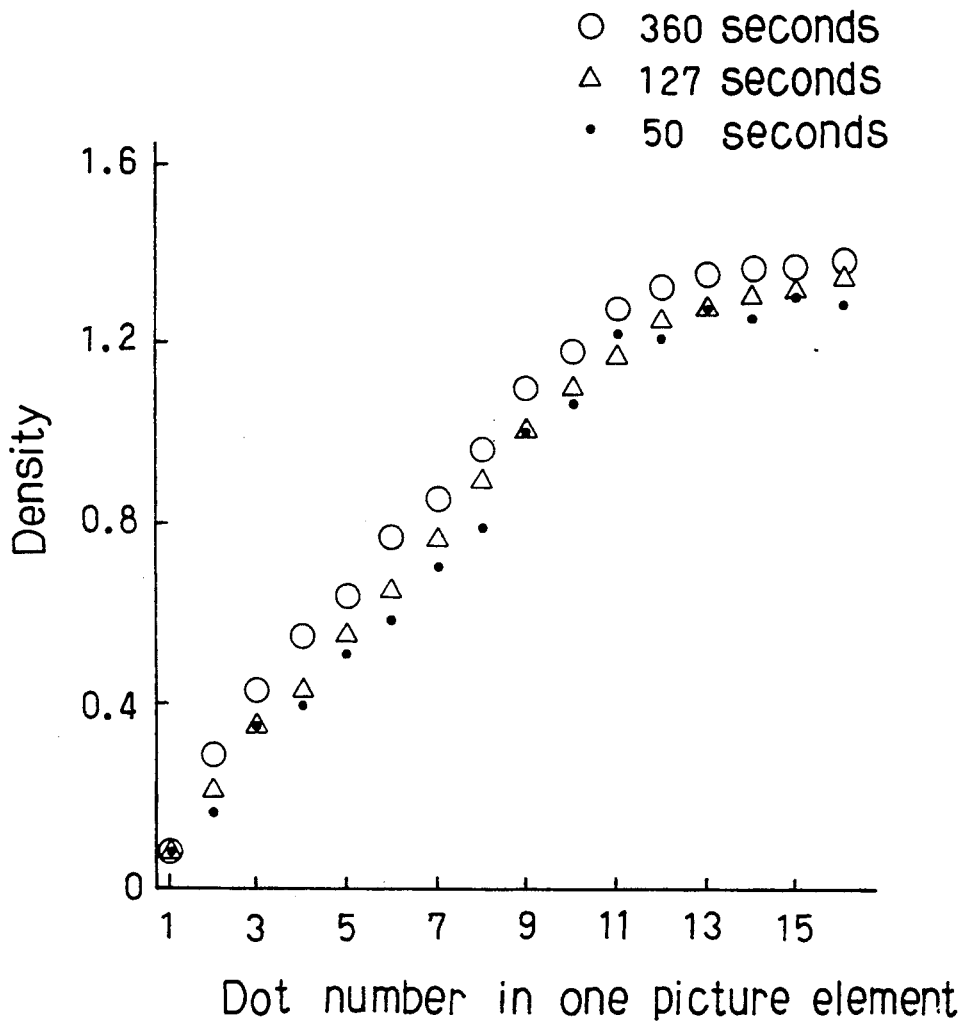
FIG. 8 is a graph showing the gradation of the dye image formed by using the transfer medium of Example 1 of the present invention.
Figure 9:
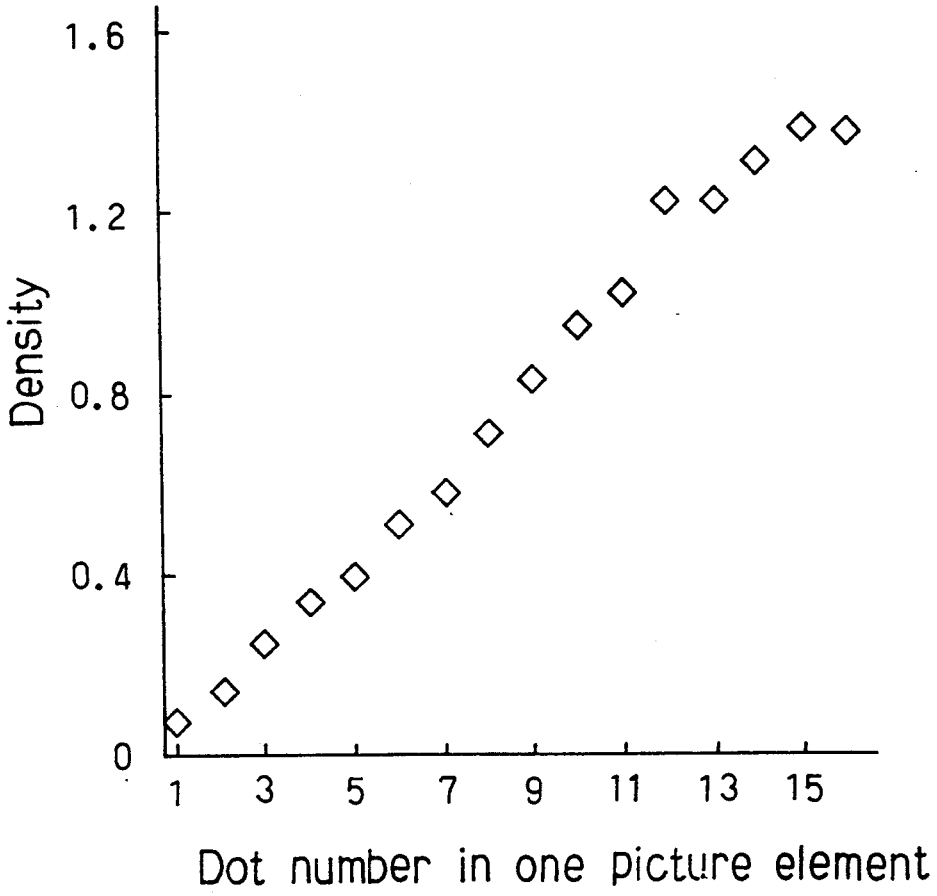
FIG. 9 is a graph showing the gradation of the dye image formed by using the transfer medium of Example 2 of the present invention.
Figure 10:
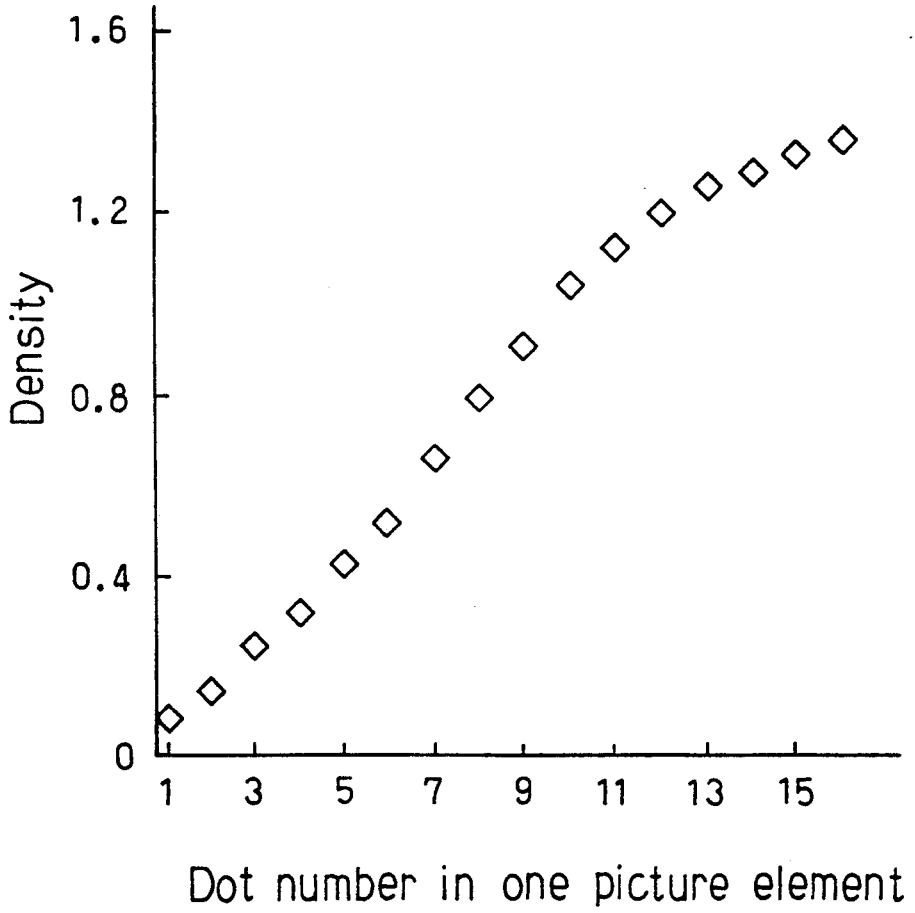
FIG. 10 is a graph showing the gradation of the dye image formed by using the transfer medium of Example 3 of the present invention.

The results are shown in FIGS. 8, 9 and 10. FIGS. 8, 9 and 10 show the results obtained by using the transfer media of Examples 1, 2 and 3, respectively. When the transfer medium of Example 1 is used, plain papers having Bekk smoothnesses of 360, 127 and 50 seconds were used as a master sheet to prepare respective masters. When the transfer media of Example 2 and Example 3 were used, only a plain paper having a smoothness of 360 seconds was used as a master sheet. In FIGS. 8 to 10, the dot number in one picture element is plotted as abscissa and the density of the dyed image as ordinate. The density of the dyed image was measured by using a densitometer, Macbeth RD-914, made by Macbeth.

As is clear from the results of FIGS. 8 to 10, dyed images with 16 gradations could be obtained from the transfer media of all embodiments. In particular, in the case of using the transfer medium of the third embodiment, a good representation of gradation was accomplished even though a master sheet having a poor smoothness was used.

(3) Test III

Employing each transfer medium mentioned above, solid-printing was conducted on a master sheet (plain paper having a Bekk smoothness of 360 seconds) by means of the printer used in Test I, and then one-dot-printing was conducted thereon with different color ink of the same transfer medium. The ink dots obtained by the one-dot-printing were observed with a metallograph and the dot reproduction represented by the following equation:

$$\text{Dot reproduction (\%)} = \frac{\text{Area of an ink dot}}{\text{Area of one heating element}} \times 100$$

was evaluated according to the following ranking. The results thereof are shown in Table 4.

A: 90 to 110%

B: not less than 80%, less than 90%

C: less than 80%

TABLE 4

| Ex. 1 | Ex. 2 | Ex. 3 | Com. Ex. |
|---|---|---|---|
| A | A | B | C |

As is clear from the results of Table 4, in the case of the transfer media of Examples 1, 2 and 3, the dot reproduction was good because the adhesiveness between the ink dots mutually superimposed was good.

(4) Test IV

Each of the heat-melt transfer media obtained in Examples 1 to 3 and Comparative Example was mounted in a full-color thermal transfer printer (Color Mate PS made by NEC Corporation). A color original was scanned with an image scanner and the separated color signals therefrom were input into the printer. A yellow ink image, a magenta ink image and a cyan ink image were successively formed and superimposed on a plain paper (Bekk smoothness: 360 seconds) according to the yellow signals, the magenta signals and the cyan signals to give a full-color master.

The master was laid on the top of the polyester fabric and the assembly was heat-pressed under the same conditions as in Test I to form a full-color image dyed on the polyester fabric. The dyed images obtained by using the transfer media of Examples 1 to 3 were good in color reproduction but the dyed image obtained by using the transfer medium of Comparative Example was poor in color reproduction.

In addition to the materials and ingredients used in the Examples, other materials and ingredients can be used in the Examples as set forth in the specification to obtain substantially the same results.

What we claim is:

1. A heat-melt transfer medium suitable for use in a sublimation transfer method which comprises using a heat-melt transfer medium with a heat-meltable ink layer containing a sublimation dye as a coloring agent, selectively melt-transferring the heat-meltable ink layer onto a sheet to form an image of the ink on the sheet, superimposing the resulting master onto a substrate so that the image faces the substrate and heating the resultant master/substrate at a temperature not less than the heat-transfer temperature of the sublimation dye to transfer the dye to the substrate, said transfer medium comprising a foundation, a release layer provided on the foundation and comprising a wax substance having a melting point of 50° to 100° C. as a major component, a heat-meltable ink layer provided on the release layer and containing a sublimation dye as a coloring agent, and an adhesive layer provided on the heat-meltable ink layer and comprising a wax substance having a melting point of 50° to 100° C. as a major component.

2. The transfer medium of claim 1, wherein said release layer and said adhesive layer have substantially the same composition.

3. The transfer medium of claim 1, wherein said heat-meltable ink layer comprises an ink layer containing a sublimation dye with yellow hue, an ink layer containing a sublimation dye with magenta hue or an ink layer containing a sublimation dye with cyan hue.

4. A heat-melt transfer medium suitable for use in a sublimation transfer method which comprises using a heat-melt transfer medium with a heat-meltable ink layer containing a sublimation dye as a coloring agent, selectively melt-transferring the heat-meltable ink layer onto a sheet to form an image of the ink on the sheet, superimposing the resulting master onto a substrate so that the image faces the substrate and heating the resultant master/substrate at a temperature not less than the heat-transfer temperature of the sublimation dye to transfer the dye to the substrate, said transfer medium comprising a foundation, a heat-meltable ink layer provided on the foundation and containing a sublimation dye as a coloring agent, and an adhesive layer provided on the ink layer and comprising a wax substance having a melting point of 50° to 100° C. as a major component.

5. The transfer medium of claim 4, wherein said heat-mealtable ink layer comprises an ink layer containing a sublimation dye with yellow hue, an ink layer containing a sublimation dye with magenta hue or an ink layer containing a sublimation dye with cyan hue.

6. A heat-melt transfer medium suitable for use in a sublimation transfer method which comprises selectively melt-transferring at least two of a heat-meltable ink layer containing a yellow sublimation dye, a heat-meltable ink layer containing a magenta sublimation dye and a heat-meltable ink layer containing a cyan sublimation dye onto a sheet to form at least two different color separation images on the sheet, superimposing the resulting master onto a substrate so that the color separation images face the substrate, and heating the resultant master/substrate at a temperature not less than the heat-transfer temperatures of the sublimation dyes to transfer the dyes to the substrate, said transfer medium comprising a foundation; a heat-meltable ink layer containing a yellow sublimation dye, a heat-meltable ink layer containing a magenta sublimation dye and a heat-meltable ink layer containing a cyan sublimation dye, which ink layers are disposed in a side-by-side relationship on the foundation; a release layer interposed between the foundation and the respective ink layers, the release layer comprising a wax substance having a melting point of 50° to 100° C. as a major component; and an adhesive layer provided on the respective ink layers, the adhesive layer comprising a wax substance having a melting point of 50° to 100° C. as a major component.

7. The transfer medium of claim 6, wherein the heat-meltable ink layers containing different color sublimation dyes are disposed in the longitudinal direction of the foundation.

8. A heat-melt transfer medium suitable for use in a sublimation transfer method which comprises selectively melt-transferring at least two of a heat-meltable ink layer containing a yellow sublimation dye, a heat-meltable ink layer containing a magenta sublimation dye and a heat-meltable ink layer containing a cyan sublimation dye onto a sheet to form at least two different color separation images on the sheet, superimposing the resulting master onto a substrate so that the color separation images face the substrate, and heating the resultant master/substrate at a temperature not less than the heat-transfer temperatures of the sublimation dyes to transfer the dyes to the substrate, said transfer medium comprising a foundation, a release layer provided on the foundation and comprising a wax substance having a melting pint of 50° to 100° C. as a major component, a heat-meltable ink layer provided on the release layer and containing a sublimation dye as a coloring agent, and an adhesive layer provided on the heat-meltable ink layer and comprising a wax substance having a melting point of 50° to 100° C. as a major component, the heat-meltable ink layer comprising a heat-meltable ink layer containing a yellow sublimation dye, a heat-meltable ink layer containing a magenta sublimation dye or a heat-meltable ink layer containing a cyan sublimation dye.

9. A heat-melt transfer medium suitable for use in a sublimation transfer method which comprises selectively melt-transferring at least two of a heat-meltable ink layer containing a yellow sublimation dye, a heat-meltable ink layer containing a magenta sublimation dye and a heat-meltable ink layer containing a cyan sublimation dye onto a sheet to form at least two different color separation images on the sheet, superimposing the resulting master onto a substrate so that the color separation images face the substrate, and heating the resultant master/substrate at a temperature not less than the heat-transfer temperatures of the sublimation dyes to transfer the dyes to the substrate, said transfer medium comprising a foundation; a heat-meltable ink layer containing a yellow sublimation dye, a heat-meltable ink layer containing a magenta sublimation dye and a heat-meltable ink layer containing a cyan sublimation dye, which ink layers are disposed in a side-by-side relationship on the foundation; and an adhesive layer provided on the respective ink layers, the adhesive layer comprising a wax substance having a melting point of 50° to 100° C. as a major component.

10. The transfer medium of claim 9, wherein the heat-meltable ink layers containing different color sublimation dyes are disposed repeatedly in the longitudinal direction of the foundation.

11. A heat-melt transfer medium suitable for use in a sublimation transfer method which comprises selectively melt-transferring at least two of a heat-meltable ink layer containing a yellow sublimation dye, a heat-meltable ink layer containing a magenta sublimation dye and a heat-meltable ink layer containing a cyan sublimation dye onto a sheet to form at least two different color separation images on the sheet, superimposing the resulting master onto a substrate so that the color separation images face the substrate, and heating the resultant master/substrate at a temperature not less than the heat-transfer temperatures of the sublimation dyes to transfer the dyes to the substrate, said transfer medium comprising a foundation, a heat-meltable ink layer provided on the foundation and containing a sublimation dye as a coloring agent, and an adhesive layer provided on the heat-meltable ink layer and comprising a wax substance having a melting point of 50° to 100° C. as a major component, the heat-meltable ink layer comprising a heat-meltable ink layer containing a yellow sublimation dye, a heat-meltable ink layer containing a magenta sublimation dye or a heat-meltable ink layer containing a cyan sublimation dye.

12. A heat-melt transfer medium suitable for use in a sublimation transfer method which comprises selectively melt-transferring at least two of a heat-meltable ink layer containing a yellow sublimation dye, a heat-meltable ink layer containing a magenta sublimation dye and a heat-meltable ink layer containing a cyan sublimation dye onto a sheet to form at least two different color separation images on the sheet, superimposing the resulting master onto a substrate so that the color separation images face the substrate, and heating the resultant master/substrate at a temperature not less than the heat-transfer temperatures of the sublimation dyes to transfer the dyes to the substrate, said transfer medium comprising a foundation; a heat-meltable ink layer containing a yellow sublimation dye, a heat-meltable ink layer containing a magenta sublimation dye and a heat-meltable ink layer containing a cyan sublimation dye, which ink layers are disposed in a side-by-side relationship on the foundation; a release layer interposed between the foundation and the respective ink layers, the release layer comprising a wax substance having a melting point of 50° to 100° C. as a major component.

13. The transfer medium of claim 12, wherein the heat-meltable ink layers containing different color sublimation dyes are disposed repeatedly in the longitudinal direction of the foundation.

14. A heat-melt transfer medium suitable for use in a sublimation transfer medium which comprises selectively melt-transferring at least two of a heat-meltable ink layer containing a yellow sublimation dye, a heat-meltable ink layer containing a magenta sublimation dye and a heat-meltable ink layer containing a cyan sublimation dye onto a sheet to form at least two different color separation images on the sheet, superimposing the resulting master onto a substrate so that the color separation images face the substrate, and heating the resultant master/substrate at a temperature not less than the heat-transfer temperatures of the sublimation dyes to transfer the dyes to the substrate, said transfer medium comprising a foundation, a release layer provided on the foundation and comprising a wax substance having a melting point of 50° to 100° C. as a major component, and a heat-meltable ink layer provided on the release layer and containing a sublimation dye as a coloring agent, the heat-meltable ink layer comprising a heat-meltable ink layer containing a yellow sublimation dye, a heat-meltable ink layer containing a magenta sublimation dye or a heat-meltable ink layer containing a cyan sublimation dye.

* * * * *